US008470222B2

(12) United States Patent
Shi et al.

(10) Patent No.: US 8,470,222 B2
(45) Date of Patent: Jun. 25, 2013

(54) FIBERS FORMED FROM A BLEND OF A MODIFIED ALIPHATIC-AROMATIC COPOLYESTER AND THERMOPLASTIC STARCH

(75) Inventors: Bo Shi, Neenah, WI (US); James H. Wang, Appleton, WI (US); Aimin He, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1419 days.

(21) Appl. No.: 12/134,511

(22) Filed: Jun. 6, 2008

(65) Prior Publication Data

US 2009/0305592 A1 Dec. 10, 2009

(51) Int. Cl.
*B29C 47/06* (2006.01)
*D02G 3/00* (2006.01)

(52) U.S. Cl.
USPC ..... 264/173.12; 264/165; 428/364

(58) Field of Classification Search
USPC ..... 523/124, 128; 525/340; 264/173.12, 264/172.19, 165, 172.11
See application file for complete search history.

(56) References Cited

U.S. PATENT DOCUMENTS

| | | | |
|---|---|---|---|
| 5,039,783 | A | 8/1991 | Brunelle et al. |
| 5,053,482 | A | 10/1991 | Tietz |
| 5,108,820 | A | 4/1992 | Kaneko et al. |
| 5,108,827 | A | 4/1992 | Gessner |
| 5,188,885 | A | 2/1993 | Timmons et al. |
| 5,231,161 | A | 7/1993 | Brunelle et al. |
| 5,262,460 | A | 11/1993 | Suzuki et al. |
| 5,270,401 | A | 12/1993 | Sham et al. |
| 5,292,783 | A | 3/1994 | Buchanan et al. |
| 5,336,552 | A | 8/1994 | Strack et al. |
| 5,350,624 | A | 9/1994 | Georger et al. |
| 5,382,400 | A | 1/1995 | Pike et al. |
| 5,407,984 | A | 4/1995 | Brunelle et al. |
| 5,432,000 | A | 7/1995 | Young, Sr. et al. |

(Continued)

FOREIGN PATENT DOCUMENTS

| | | |
|---|---|---|
| EP | 0731198 A2 | 9/1996 |
| EP | 0731198 A3 | 9/1996 |

(Continued)

OTHER PUBLICATIONS

Search Report and Written Opinion for PCT/IB2009/051555 dated Dec. 17, 2009, 12 pages.

(Continued)

*Primary Examiner* — Lynda Salvatore
(74) *Attorney, Agent, or Firm* — Dority & Manning, P.A.

(57) ABSTRACT

A fiber formed from a thermoplastic composition that contains a thermoplastic starch and an aliphatic-aromatic copolyester is provided. The copolyester enhances the strength of the starch-containing fibers and also facilitates the ability of the starch to be melt processed. Due to its relatively low melting point, the aliphatic-aromatic copolyester may also be extruded with the thermoplastic starch at a temperature that is low enough to avoid substantial removal of the moisture found in the starch. Furthermore, the aliphatic-aromatic copolyester is also modified with an alcohol so that it contains one or more hydroxyalkyl or alkyl terminal groups. By selectively controlling the conditions of the alcoholysis reaction (e.g., alcohol and copolymer concentrations, temperature, etc.), the resulting modified aliphatic-aromatic copolyester may have a molecular weight that is relatively low. Such low molecular weight polymers have the combination of a higher melt flow index and lower apparent viscosity, which is useful in a wide variety of fiber forming applications, such as in the meltblowing of nonwoven webs.

17 Claims, 2 Drawing Sheets

U.S. PATENT DOCUMENTS

| | | | |
|---|---|---|---|
| 5,446,079 | A | 8/1995 | Buchanan et al. |
| 5,464,688 | A | 11/1995 | Timmons et al. |
| 5,466,517 | A | 11/1995 | Eschwey et al. |
| 5,527,976 | A | 6/1996 | Takekoshi et al. |
| 5,554,657 | A | 9/1996 | Brownscombe et al. |
| 5,559,171 | A | 9/1996 | Buchanan et al. |
| 5,580,911 | A | 12/1996 | Buchanan et al. |
| 5,593,778 | A | 1/1997 | Kondo et al. |
| 5,599,858 | A | 2/1997 | Buchanan et al. |
| 5,614,298 | A | 3/1997 | Tanaka et al. |
| 5,668,186 | A | 9/1997 | Brunelle et al. |
| 5,688,582 | A | 11/1997 | Nagaoka et al. |
| 5,753,736 | A | 5/1998 | Bhat et al. |
| 5,783,505 | A | 7/1998 | Duckett et al. |
| 5,817,199 | A | 10/1998 | Brennecke et al. |
| 5,817,721 | A | 10/1998 | Warzelhan et al. |
| 5,851,937 | A | 12/1998 | Wu et al. |
| 5,895,710 | A | 4/1999 | Sasse et al. |
| 5,900,322 | A | 5/1999 | Buchanan et al. |
| 5,910,545 | A | 6/1999 | Tsai et al. |
| 5,945,480 | A | 8/1999 | Wang et al. |
| 5,952,433 | A | 9/1999 | Wang et al. |
| 6,045,908 | A | 4/2000 | Nakajima et al. |
| 6,063,895 | A | 5/2000 | Chung et al. |
| 6,075,118 | A | 6/2000 | Wang et al. |
| 6,090,494 | A | 7/2000 | Rao |
| 6,177,193 | B1 | 1/2001 | Tsai et al. |
| 6,194,483 | B1 | 2/2001 | Tsai et al. |
| 6,197,860 | B1 | 3/2001 | Tsai et al. |
| 6,201,068 | B1 | 3/2001 | Tsai et al. |
| 6,218,321 | B1 | 4/2001 | Lorcks et al. |
| 6,225,388 | B1 | 5/2001 | Tsai et al. |
| 6,231,970 | B1 | 5/2001 | Andersen et al. |
| 6,235,393 | B1 | 5/2001 | Kimura et al. |
| 6,235,815 | B1 | 5/2001 | Loercks et al. |
| 6,235,816 | B1 | 5/2001 | Lorcks et al. |
| 6,245,831 | B1 | 6/2001 | Tsai et al. |
| 6,258,924 | B1 | 7/2001 | Warzelhan et al. |
| 6,268,434 | B1 | 7/2001 | Tsai et al. |
| 6,399,716 | B2 | 6/2002 | Chung et al. |
| 6,420,027 | B2 | 7/2002 | Kimura et al. |
| 6,420,048 | B1 | 7/2002 | Wang |
| 6,495,656 | B1 | 12/2002 | Haile et al. |
| 6,500,897 | B2 | 12/2002 | Wang et al. |
| 6,506,873 | B1 | 1/2003 | Ryan et al. |
| 6,525,164 | B2 | 2/2003 | Faler |
| 6,544,455 | B1 | 4/2003 | Tsai |
| 6,552,124 | B2 | 4/2003 | Wang et al. |
| 6,552,162 | B1 | 4/2003 | Wang et al. |
| 6,562,938 | B2 | 5/2003 | Haile et al. |
| 6,576,576 | B1 | 6/2003 | Wang et al. |
| 6,579,934 | B1 | 6/2003 | Schertz et al. |
| 6,607,996 | B1 | 8/2003 | Matsunaga et al. |
| 6,623,853 | B2 | 9/2003 | Branum et al. |
| 6,623,854 | B2 | 9/2003 | Bond |
| 6,635,799 | B1 | 10/2003 | Osborn, III et al. |
| 6,660,211 | B2 | 12/2003 | Topolkaraev et al. |
| 6,686,303 | B1 | 2/2004 | Haynes et al. |
| 6,709,526 | B1 | 3/2004 | Bailey et al. |
| 6,713,595 | B2 | 3/2004 | Chung et al. |
| 6,740,401 | B1 | 5/2004 | Yahata et al. |
| 6,743,506 | B2 | 6/2004 | Bond et al. |
| 6,756,412 | B2 | 6/2004 | Muzzy |
| 6,783,854 | B2 | 8/2004 | Bond |
| 6,787,493 | B1 | 9/2004 | Nagaoka et al. |
| 6,802,895 | B2 | 10/2004 | Mackey et al. |
| 6,811,740 | B2 | 11/2004 | James et al. |
| 6,838,403 | B2 | 1/2005 | Tsai et al. |
| 6,863,971 | B2 | 3/2005 | Halahmi et al. |
| 6,872,674 | B2 | 3/2005 | Williams et al. |
| 6,890,872 | B2 | 5/2005 | Bond et al. |
| 6,890,989 | B2 | 5/2005 | Wang et al. |
| 6,905,759 | B2 | 6/2005 | Topolkaraev et al. |
| 6,946,195 | B2 | 9/2005 | Griffith et al. |
| 6,946,506 | B2 | 9/2005 | Bond et al. |
| 6,953,622 | B2 | 10/2005 | Tsai et al. |
| 7,001,562 | B2 | 2/2006 | Schiffer et al. |
| 7,029,620 | B2 | 4/2006 | Gordon et al. |
| 7,037,983 | B2 | 5/2006 | Huang et al. |
| 7,053,151 | B2 | 5/2006 | Wang et al. |
| 7,060,867 | B2 | 6/2006 | Jameson |
| 7,077,994 | B2 | 7/2006 | Bond et al. |
| 7,101,623 | B2 | 9/2006 | Jordan et al. |
| 7,153,569 | B2 | 12/2006 | Kaufman et al. |
| 7,193,032 | B2 | 3/2007 | Culbert et al. |
| 7,241,838 | B2 | 7/2007 | Shelby et al. |
| 7,368,503 | B2 | 5/2008 | Hale |
| 7,468,335 | B2 | 12/2008 | Imes et al. |
| 2002/0127939 | A1 | 9/2002 | Hwo et al. |
| 2002/0168912 | A1 | 11/2002 | Bond et al. |
| 2003/0022569 | A1 | 1/2003 | Lee et al. |
| 2003/0022581 | A1 | 1/2003 | Tsai et al. |
| 2003/0092343 | A1 | 5/2003 | Bond et al. |
| 2003/0134915 | A1 | 7/2003 | Scantlebury et al. |
| 2003/0176136 | A1 | 9/2003 | Wadsworth |
| 2003/0191442 | A1 | 10/2003 | Bewick-Sonntag et al. |
| 2004/0000313 | A1 | 1/2004 | Gaynor et al. |
| 2004/0002273 | A1 | 1/2004 | Fitting et al. |
| 2004/0053047 | A1 | 3/2004 | Jackson et al. |
| 2004/0102123 | A1 | 5/2004 | Bowen, Jr. et al. |
| 2004/0132873 | A1 | 7/2004 | Bailey et al. |
| 2005/0054999 | A1 | 3/2005 | Morman et al. |
| 2005/0112350 | A1 | 5/2005 | Ning |
| 2005/0112363 | A1 | 5/2005 | Ning |
| 2005/0208294 | A1 | 9/2005 | Kaufman et al. |
| 2007/0082573 | A1 | 4/2007 | Noda et al. |
| 2007/0219339 | A1 | 9/2007 | Fregoso-Infante et al. |

FOREIGN PATENT DOCUMENTS

| | | | |
|---|---|---|---|
| EP | 0905292 | A1 | 3/1999 |
| EP | 1397536 | B1 | 3/2004 |
| EP | 1397537 | B1 | 3/2004 |
| EP | 1397538 | B1 | 3/2004 |
| EP | 1397539 | B1 | 3/2004 |
| JP | 7109659 | | 4/1995 |
| JP | 7125128 | | 5/1995 |
| JP | 11043857 | | 2/1999 |
| JP | 11050369 | | 2/1999 |
| JP | 11117164 | | 4/1999 |
| JP | 11286864 | | 10/1999 |
| JP | 2001 172829 | A | 6/2001 |
| JP | 2003 064568 | | 3/2003 |
| JP | 2003 193349 | A | 7/2003 |
| JP | 2005 048350 | A | 2/2005 |
| WO | WO 9850611 | A1 | 11/1998 |
| WO | WO 02090629 | A1 | 11/2002 |
| WO | WO 02090630 | A1 | 11/2002 |
| WO | WO 2004061172 | A2 | 7/2004 |
| WO | WO 2004061172 | A3 | 7/2004 |
| WO | WO 2007070064 | A1 | 6/2007 |
| WO | WO 2008008067 | A1 | 1/2008 |
| WO | WO 2008008068 | A1 | 1/2008 |
| WO | WO 2008008074 | A1 | 1/2008 |
| WO | WO 2008073099 | A1 | 6/2008 |

OTHER PUBLICATIONS

Abstract of Korean Patent No. KR1020010057068A, Jul. 4, 2001.
Abstract of Korean Patent No. KR1020030022514A, Mar. 17, 2003.
Abstract of Korean Patent No. KR1020040005193A, Jan. 16, 2004.
Abstract of Korean Patent No. KR1020040005194A, Jan. 16, 2004.
ASTM D 1117-97—*Standard Test Methods for Nonwoven Fabrics*, Mar. 10, 1997, pp. 311-313.
ASTM D 1238-04c—*Standard Test Method for Melt Flow Rates of Thermoplastics by Extrusion Plastometer*, current edition approved Dec. 1, 2004, originally approved in 1965, pp. 1-14.
ASTM D 1239-92—*Standard Test Method for Resistance of Plastic Films to Extraction by Chemicals*, current edition approved Aug. 15, 1992, pp. 281-282.
ASTM D 3418-03 (D 3417-99)—*Standard Test Method for Transition Temperatures and Enthalpies of Fusion and Crystallization of Polymers by Differential Scanning Calorimetry*, current edition approved Dec. 1, 2003, originally approved in 1975, pp. 66-72.
ASTM D 5034-95—*Standard Test Method for Breaking Strength and Elongation of Textile Fabrics* (*Grab Test*), current edition approved May 15, 1995, pp. 674-681.

ASTM D 5338-92—*Standard Test Method for Determining Aerobic Biodegradation of Plastic Materials Under Controlled Composting Conditions*, current edition approved Dec. 15, 1992, pp. 456-461.

ASTM D 7191-05—*Standard Test Method for Determination of Moisture in Plastics by Relative Humidity Sensor*, current edition approved Nov. 1, 2005, pp. 1-4.

Article—*Biodegradation of aliphatic-aromatic copolyesters: evaluation of the final biodegradability and ecotoxicological impact of degradation intermediates*, Witt et al., Chemosphere 44, 2001, pp. 289-299.

Article—*Rheological Properties of Poly(lactides). Effect of Molecular Weight and Temperature on the Viscoelasticity of Poly(l-lactic acid)*, Cooper-White et al., Journal of Polymer Science: Part B: Polymer Physics, vol. 37, 1999, pp. 1803-1814.

Article—*Synthesis of Oligoester α,ω-diols by Alcoholysis of PET through the Reactive Extrusion Process*, Dannoux et al., The Canadian Journal of Chemical Engineering, vol. 80, Dec. 2002, pp. 1075-1082.

Product Information on Ecoflex® from BASF—The Chemical Company, Sep. 22, 2005, 4 pages.

Product Information from Ingeo and NatureWorks®—PLA Polymer 6201D, 6202D, and 6302D, 2005, 11 pages.

FIBERS FORMED FROM A BLEND OF A MODIFIED ALIPHATIC-AROMATIC COPOLYESTER AND THERMOPLASTIC STARCH

BACKGROUND OF THE INVENTION

Due to its renewability and generally low cost, various attempts have been made to form fibers from starch. Conventionally, starch fibers have been produced using a wet-spinning process. For example, a starch/solvent colloidal suspension may be extruded from a spinneret into a coagulating bath. This process relied on the marked tendency of amylose to align and form strongly associated aggregates to provide strength and integrity to the final fiber. Any amylopectin present was tolerated as an impurity that adversely affected the fiber spinning process and the strength of the final product. Because it was well known that natural starch was rich in amylopectin, earlier approaches included pre-treating the natural starch to obtain the amylose-rich portion desirable for fiber spinning. However, this approach was not economically feasible on a commercial scale because a large portion (i.e., the amylopectin portion) of the starch was discarded. More recently, attempts have been made to melt spin starch into fibers. U.S. Pat. No. 6,890,872 to Bond, et al., for example, describes highly attenuated fibers produced by melt spinning a composition comprising destructurized starch, a biodegradable thermoplastic polymer, and a plasticizer. Unfortunately, however, such fibers are believed to possess inadequate strength and mechanical properties for use in many applications.

As such, a need currently exists for starch fibers that exhibit good mechanical properties.

SUMMARY OF THE INVENTION

In accordance with one embodiment of the present invention, a fiber is disclosed that is formed from a thermoplastic composition that comprises from about 5 wt. % to about 40 wt. % of at least one thermoplastic starch and from about 60 wt. % to about 95 wt. % of an aliphatic-aromatic copolyester terminated with an alkyl group, hydroxyalkyl group, or a combination thereof. The copolyester has a melt flow index of from about 5 to about 200 grams per 10 minutes, determined at a load of 2160 grams and temperature of 190° C. in accordance with ASTM Test Method D1238-E.

In accordance with another embodiment of the present invention, a method for forming a fiber is disclosed that comprises reacting a first aliphatic-aromatic copolyester with at least one alcohol to result in a second, modified copolyester having a melt flow index that is greater than the melt flow index of the first copolyester, determined at a load of 2160 grams and temperature of 190° C. in accordance with ASTM Test Method D1238-E; combining the second copolyester with a thermoplastic starch to form a blend; and extruding the blend through a die to form a fiber.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
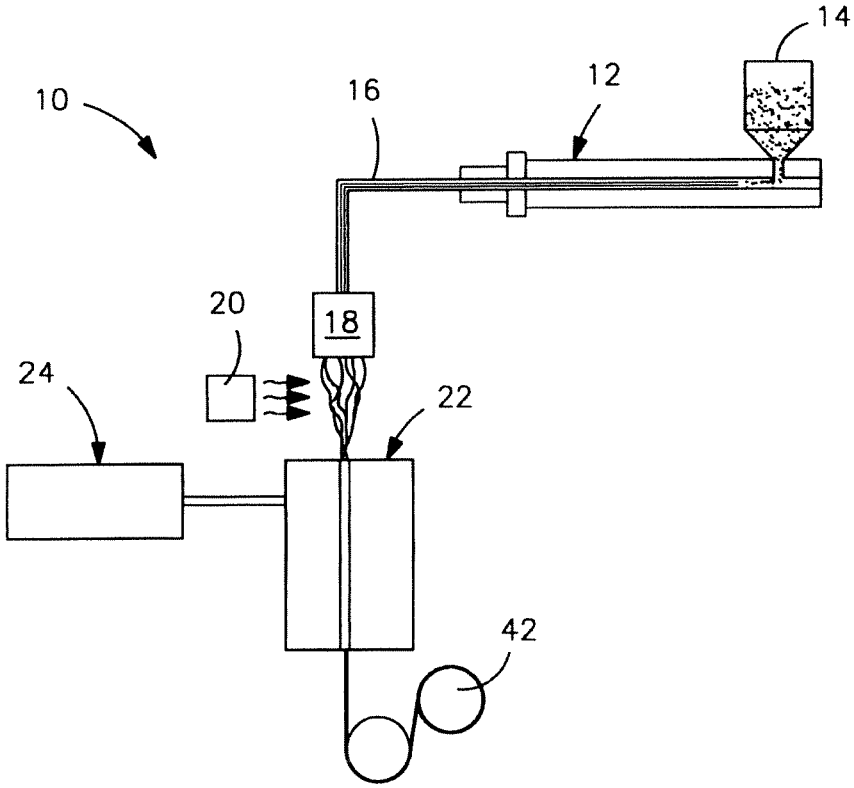
FIG. 1 is a schematic illustration of a process that may be used in one embodiment of the present invention to form fibers.

Repeat use of references characters in the present specification and drawings is intended to represent same or analogous features or elements of the invention.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention covers such modifications and variations as come within the scope of the appended claims and their equivalents.

DEFINITIONS

As used herein, the term "biodegradable" or "biodegradable polymer" generally refers to a material that degrades from the action of naturally occurring microorganisms, such as bacteria, fungi, and algae; environmental heat; moisture; or other environmental factors. The biodegradability of a material may be determined using ASTM Test Method 5338.92.

As used herein, the term "fibers" refer to elongated extrudates formed by passing a polymer through a forming orifice such as a die. Unless noted otherwise, the term "fibers" includes discontinuous fibers having a definite length and substantially continuous filaments. Substantially filaments may, for instance, have a length much greater than their diameter, such as a length to diameter ratio ("aspect ratio") greater than about 15,000 to 1, and in some cases, greater than about 50,000 to 1.

As used herein, the term "monocomponent" refers to fibers formed from one polymer. Of course, this does not exclude fibers to which additives have been added for color, anti-static properties, lubrication, hydrophilicity, liquid repellency, etc.

As used herein, the term "multicomponent" refers to fibers formed from at least two polymers (e.g., bicomponent fibers) that are extruded from separate extruders. The polymers are arranged in substantially constantly positioned distinct zones across the cross-section of the fibers. The components may be arranged in any desired configuration, such as sheath-core, side-by-side, segmented pie, island-in-the-sea, and so forth. Various methods for forming multicomponent fibers are described in U.S. Pat. No. 4,789,592 to Taniguchi et al. and U.S. Pat. No. 5,336,552 to Strack et al., U.S. Pat. No. 5,108,820 to Kaneko, et al., U.S. Pat. No. 4,795,668 to Kruege, et al., U.S. Pat. No. 5,382,400 to Pike, et al., U.S. Pat. No. 5,336,552 to Strack, et al., and U.S. Pat. No. 6,200,669 to Marmon, et al., which are incorporated herein in their entirety by reference thereto for all purposes. Multicomponent fibers having various irregular shapes may also be formed, such as described in U.S. Pat. No. 5,277,976 to Hogle, et al., U.S. Pat.

No. 5,162,074 to Hills, U.S. Pat. No. 5,466,410 to Hills, U.S. Pat. No. 5,069,970 to Largman, et al., and U.S. Pat. No. 5,057,368 to Largman, et al., which are incorporated herein in their entirety by reference thereto for all purposes.

As used herein, the term "multiconstituent" refers to fibers formed from at least two polymers (e.g., biconstituent fibers) that are extruded as a blend. The polymers are not arranged in substantially constantly positioned distinct zones across the cross-section of the fibers. Various multiconstituent fibers are described in U.S. Pat. No. 5,108,827 to Gessner, which is incorporated herein in its entirety by reference thereto for all purposes.

As used herein, the term "nonwoven web" refers to a web having a structure of individual fibers that are randomly interlaid, not in an identifiable manner as in a knitted fabric. Nonwoven webs include, for example, meltblown webs, spunbond webs, carded webs, wet-laid webs, airlaid webs, coform webs, hydraulically entangled webs, etc. The basis weight of the nonwoven web may generally vary, but is typically from about 5 grams per square meter ("gsm") to 200 gsm, in some embodiments from about 10 gsm to about 150 gsm, and in some embodiments, from about 15 gsm to about 100 gsm.

As used herein, the term "meltblown" web or layer generally refers to a nonwoven web that is formed by a process in which a molten thermoplastic material is extruded through a plurality of fine, usually circular, die capillaries as molten fibers into converging high velocity gas (e.g. air) streams that attenuate the fibers of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin, et al.; U.S. Pat. No. 4,307,143 to Meitner, et al.; and U.S. Pat. No. 4,707,398 to Wisneski, et al., which are incorporated herein in their entirety by reference thereto for all purposes. Meltblown fibers may be substantially continuous or discontinuous, and are generally tacky when deposited onto a collecting surface.

As used herein, the term "spunbond" web or layer generally refers to a nonwoven web containing small diameter substantially continuous filaments. The filaments are formed by extruding a molten thermoplastic material from a plurality of fine, usually circular, capillaries of a spinnerette with the diameter of the extruded filaments then being rapidly reduced as by, for example, eductive drawing and/or other well-known spunbonding mechanisms. The production of spunbond webs is described and illustrated, for example, in U.S. Pat. No. 4,340,563 to Appel, et al., U.S. Pat. No. 3,692,618 to Dorschner, et al., U.S. Pat. No. 3,802,817 to Matsuki, et al., U.S. Pat. No. 3,338,992 to Kinney, U.S. Pat. No. 3,341,394 to Kinney, U.S. Pat. No. 3,502,763 to Hartman, U.S. Pat. No. 3,502,538 to Levy, U.S. Pat. No. 3,542,615 to Dobo, et al., and U.S. Pat. No. 5,382,400 to Pike, et al., which are incorporated herein in their entirety by reference thereto for all purposes. Spunbond filaments are generally not tacky when they are deposited onto a collecting surface. Spunbond filaments may sometimes have diameters less than about 40 micrometers, and are often between about 5 to about 20 micrometers.

DETAILED DESCRIPTION

The present invention is directed to a fiber formed from a thermoplastic composition that contains a thermoplastic starch and an aliphatic-aromatic copolyester. The copolyester enhances the strength of the starch-containing fibers and also facilitates the ability of the starch to be melt processed. Due to its relatively low melting point, the aliphatic-aromatic copolyester may also be extruded with the thermoplastic starch at a temperature that is low enough to avoid substantial removal of the moisture found in the starch. Furthermore, the aliphatic-aromatic copolyester is also modified with an alcohol so that it contains one or more hydroxyalkyl or alkyl terminal groups. By selectively controlling the conditions of the alcoholysis reaction (e.g., alcohol and copolymer concentrations, temperature, etc.), the resulting modified aliphatic-aromatic copolyester may have a molecular weight that is relatively low. Such low molecular weight polymers have the combination of a higher melt flow index and lower apparent viscosity, which is useful in a wide variety of fiber forming applications, such as in the meltblowing of nonwoven webs. Various embodiments of the present invention will now be described in more detail.

I. Thermoplastic Composition

The relative percentage of the thermoplastic starch and modified aliphatic-aromatic copolyester are selectively controlled to achieve the desired fiber strength. For example, compositions with too great a starch content generally exhibit poor mechanical properties. On the other hand, too low of a starch content reduces the renewability benefits imparted by using natural polymers. In this regard, the thermoplastic composition used to form the fibers contains from about 5 wt. % to about 40 wt. %, in some embodiments from about 10 wt. % to about 35 wt. %, and in some embodiments, from about 15 wt. % to about 30 wt. % of at least one thermoplastic starch. Likewise, the thermoplastic composition also contains from about 60 wt. % to about 95 wt. %, in some embodiments from about 65 wt. % to about 90 wt. %, and in some embodiments, from about 70 wt. % to about 85 wt. % of at least one modified aliphatic-aromatic copolyester.

A. Modified Aliphatic-Aromatic Copolyester

As indicated above, the thermoplastic composition of the present invention includes an aliphatic-aromatic copolyester modified with an alcohol. The aliphatic-aromatic copolyester may be synthesized using any known technique, such as through the condensation polymerization of a polyol in conjunction with aliphatic and aromatic dicarboxylic acids or anhydrides thereof. The polyols may be substituted or unsubstituted, linear or branched, polyols selected from polyols containing 2 to about 12 carbon atoms and polyalkylene ether glycols containing 2 to 8 carbon atoms. Examples of polyols that may be used include, but are not limited to, ethylene glycol, diethylene glycol, propylene glycol, 1,2-propanediol, 1,3-propanediol, 2,2-dimethyl-1,3-propanediol, 1,2-butanediol, 1,3-butanediol, 1,4-butanediol, 1,2-pentanediol, 1,5-pentanediol, 1,6-hexanediol, polyethylene glycol, diethylene glycol, 2,2,4-trimethyl-1,6-hexanediol, thiodiethanol, 1,3-cyclohexanedimethanol, 1,4-cyclohexanedimethanol, 2,2,4,4-tetramethyl-1,3-cyclobutanediol, cyclopentanediol, triethylene glycol, and tetraethylene glycol. Preferred polyols include 1,4-butanediol; 1,3-propanediol; ethylene glycol; 1,6-hexanediol; diethylene glycol; and 1,4-cyclohexanedimethanol.

Representative aliphatic dicarboxylic acids that may be used include substituted or unsubstituted, linear or branched, non-aromatic dicarboxylic acids selected from aliphatic dicarboxylic acids containing 2 to about 10 carbon atoms, and derivatives thereof. Non-limiting examples of aliphatic dicarboxylic acids include malonic, malic, succinic, oxalic, glutaric, adipic, pimelic, azelaic, sebacic, fumaric, 2,2-dimethyl glutaric, suberic, 1,3-cyclopentanedicarboxylic, 1,4-cyclohexanedicarboxylic, 1,3-cyclohexanedicarboxylic, diglycolic, itaconic, maleic, and 2,5-norbornanedicarboxylic. Representative aromatic dicarboxylic acids that may be used include substituted and unsubstituted, linear or branched, aromatic dicarboxylic acids selected from aromatic dicarboxylic acids containing 8 or more carbon atoms, and derivatives thereof. Non-limiting examples of aromatic dicarboxylic acids include terephthalic acid, dimethyl terephthalate, isophthalic acid, dimethyl isophthalate, 2,6-napthalene dicarboxylic acid, dimethyl-2,6-naphthalate, 2,7-naphthalenedicarboxylic acid, dimethyl-2,7-naphthalate, 3,4'-diphenyl ether dicarboxylic acid, dimethyl-3,4'-diphenyl ether dicarboxylate, 4,4'-diphenyl ether dicarboxylic acid, dimethyl-4,4'-diphenyl ether dicarboxylate, 3,4'-diphenyl sulfide dicarboxylic acid, dimethyl-3,4'-diphenyl sulfide dicarboxylate, 4,4'-diphenyl sulfide dicarboxylic acid, dimethyl-4,4'-diphenyl sulfide dicarboxylate, 3,4'-diphenyl sulfone dicarboxylic acid, dimethyl-3,4'-diphenyl sulfone dicarboxylate, 4,4'-diphenyl sulfone dicarboxylic acid, dimethyl-4,4'-diphenyl sulfone dicarboxylate, 3,4'-benzophenonedicarboxylic acid, dimethyl-3,4'-benzophenonedicarboxylate, 4,4'-benzophenonedicarboxylic acid, dimethyl-4,4'-benzophenonedicarboxylate, 1,4-naphthalene dicarboxylic acid, dimethyl-1,4-naphthalate, 4,4'-methylene bis(benzoic acid), dimethyl-4,4'-methylenebis(benzoate), etc., and mixtures thereof.

If desired, a diisocyanate chain extender may be reacted with the copolyester to increase its molecular weight. Representative diisocyanates may include toluene 2,4-diisocyanate, toluene 2,6-diisocyanate, 2,4'-diphenylmethane diisocyanate, naphthylene-1,5-diisocyanate, xylylene diisocyanate, hexamethylene diisocyanate ("HMDI"), isophorone diisocyanate and methylenebis(2-isocyanatocyclohexane). Trifunctional isocyanate compounds may also be employed that contain isocyanurate and/or biurea groups with a functionality of not less than three, or to replace the diisocyanate compounds partially by tri- or polyisocyanates. The preferred diisocyanate is hexamethylene diisocyanate. The amount of the chain extender employed is typically from about 0.3 to about 3.5 wt. %, in some embodiments, from about 0.5 to about 2.5 wt. % based on the total weight percent of the polymer.

The copolyesters may either be a linear polymer or a long-chain branched polymer. Long-chain branched polymers are generally prepared by using a low molecular weight branching agent, such as a polyol, polycarboxylic acid, hydroxy acid, and so forth. Representative low molecular weight polyols that may be employed as branching agents include glycerol, trimethylolpropane, trimethylolethane, polyethertriols, 1,2,4-butanetriol, pentaerythritol, 1,2,6-hexanetriol, sorbitol, 1,1,4,4,-tetrakis(hydroxymethyl)cyclohexane, tris(2-hydroxyethyl)isocyanurate, and dipentaerythritol. Representative higher molecular weight polyols (molecular weight of 400 to 3000) that may be used as branching agents include triols derived by condensing alkylene oxides having 2 to 3 carbons, such as ethylene oxide and propylene oxide with polyol initiators. Representative polycarboxylic acids that may be used as branching agents include hemimellitic acid, trimellitic (1,2,4-benzenetricarboxylic) acid and anhydride, trimesic (1,3,5-benzenetricarboxylic) acid, pyromellitic acid and anhydride, benzenetetracarboxylic acid, benzophenone tetracarboxylic acid, 1,1,2,2-ethane-tetracarboxylic acid, 1,1,2-ethanetricarboxylic acid, 1,3,5-pentanetricarboxylic acid, and 1,2,3,4-cyclopentanetetracarboxylic acid. Representative hydroxy acids that may be used as branching agents include malic acid, citric acid, tartaric acid, 3-hydroxyglutaric acid, mucic acid, trihydroxyglutaric acid, 4-carboxyphthalic anhydride, hydroxyisophthalic acid, and 4-(beta-hydroxyethyl)phthalic acid. Such hydroxy acids contain a combination of 3 or more hydroxyl and carboxyl groups. Especially preferred branching agents include trimellitic acid, trimesic acid, pentaerythritol, trimethylol propane and 1,2,4-butanetriol.

The aromatic dicarboxylic acid monomer constituent may be present in the copolyester in an amount of from about 10 mole % to about 40 mole %, in some embodiments from about 15 mole % to about 35 mole %, and in some embodiments, from about 15 mole % to about 30 mole %. The aliphatic dicarboxylic acid monomer constituent may likewise be present in the copolyester in an amount of from about 15 mole % to about 45 mole %, in some embodiments from about 20 mole % to about 40 mole %, and in some embodiments, from about 25 mole % to about 35 mole %. The polyol monomer constituent may also be present in the aliphatic-aromatic copolyester in an amount of from about 30 mole % to about 65 mole %, in some embodiments from about 40 mole % to about 50 mole %, and in some embodiments, from about 45 mole % to about 55 mole %.

In one particular embodiment, for example, the aliphatic-aromatic copolyester may comprise the following structure:

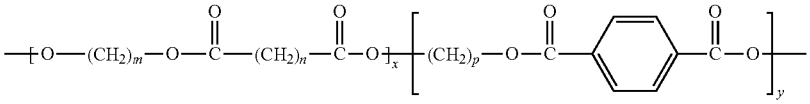

wherein, m is an integer from 2 to 10, in some embodiments from 2 to 4, and in one embodiment, 4;

n is an integer from 0 to 18, in some embodiments from 2 to 4, and in one embodiment, 4;

p is an integer from 2 to 10, in some embodiments from 2 to 4, and in one embodiment, 4;

x is an integer greater than 1; and y is an integer greater than 1. One example of such a copolyester is polybutylene adipate terephthalate, which is commercially available under the designation ECOFLEX® F BX 7011 from BASF Corp. Another example of a suitable copolyester containing an aromatic terephthalic acid monomer constituent is available under the designation ENPOL™ 8060M from IRE Chemicals (South Korea). Other suitable aliphatic-aromatic copolyesters may be described in U.S. Pat. Nos. 5,292,783; 5,446,079; 5,559,171; 5,580,911; 5,599,858; 5,817,721; 5,900,322; and 6,258,924, which are incorporated herein in their entirety by reference thereto for all purposes.

As indicated above, the aliphatic-aromatic copolyester is modified with an alcohol to form a modified copolyester having a reduced molecular weight. The concentration of the alcohol reactant may influence the extent to which the molecular weight is altered. For instance, higher alcohol concentrations generally result in a more significant decrease in molecular weight. Of course, too high of an alcohol concentration may also affect the physical characteristics of the resulting polymer. Thus, in most embodiments, the alcohol(s) are employed in an amount of about 0.1 wt. % to about 10 wt. %, in some embodiments from about 0.1 wt. % to about 4 wt.

%, and in some embodiments, from about 0.2 wt. % to about 1 wt. %, based on the total weight of the starting aliphatic-aromatic copolyester.

The alcohol may be monohydric or polyhydric (dihydric, trihydric, tetrahydric, etc.), saturated or unsaturated, and optionally substituted with functional groups, such as carboxyl, amine, etc. Examples of suitable monohydric alcohols include methanol, ethanol, 1-propanol, 2-propanol, 1-butanol, 2-butanol, 1-pentanol, 2-pentanol, 3-pentanol, 1-hexanol, 2-hexanol, 3-hexanol, 1-heptanol, 2-heptanol, 3-heptanol, 4-heptanol, 1-octanol, 2-octanol, 3-octanol, 4-octanol, 1-nonanol, 2-nonanol, 3-nonanol, 4-nonanol, 5-nonanol, 1-decanol, 2-decanol, 3-decanol, 4-decanol, 5-decanol, allyl alcohol, 1-butenol, 2-butenol, 1-pentenol, 2-pentenol, 1-hexenol, 2-hexenol, 3-hexenol, 1-heptenol, 2-heptenol, 3-heptenol, 1-octenol, 2-octenol, 3-octenol, 4-octenol, 1-nonenol, 2-nonenol, 3-nonenol, 4-nonenol, 1-decenol, 2-decenol, 3-decenol, 4-decenol, 5-decenol, cyclohexanol, cyclopentanol, cycloheptanol, 1-phenythyl alcohol, 2-phenythyl alcohol, 2-ethoxy-ethanol, methanolamine, ethanolamine, and so forth. Examples of suitable dihydric alcohols include 1,3-propanediol, 1,4-butanediol, 1,5-pentanediol, 1,6-hexanediol, 1,7-heptanediol, 1,8-octanediol, 1,2-cyclohexanedimethanol, 1,3-cyclohexanedimethanol, 1-hydroxymethyl-2-hydroxyethylcyclohexane, 1-hydroxy-2-hydroxypropylcyclohexane, 1-hydroxy-2-hydroxyethylcyclohexane, 1-hydroxymethyl-2-hydroxyethylbenzene, 1-hydroxymethyl-2-hydroxypropylbenzene, 1-hydroxy-2-hydroxyethylbenzene, 1,2-benzylmethylol, 1,3-benzyldimethylol, and so forth. Suitable trihydric alcohols may include glycerol, trimethylolpropane, etc., while suitable tetrahydric alcohols may include pentaerythritol, erythritol, etc. Preferred alcohols are dihydric alcohols having from 2 to 6 carbon atoms, such as 1,3-propanediol and 1,4-butanediol.

The hydroxy group of the alcohol is generally capable of attacking an ester linkage of the aliphatic-aromatic copolyester, thereby leading to chain scission or "depolymerization" of the copolyester molecule into one or more shorter ester chains. The shorter chains may include aliphatic-aromatic copolyesters and/or oligomers thereof. Although not necessarily required, the short chain aliphatic-aromatic copolyesters formed during alcoholysis are often terminated with an alkyl and/or hydroxyalkyl groups derived from the alcohol. Alkyl group terminations are typically derived from monohydric alcohols, while hydroxyalkyl group terminations are typically derived from polyhydric alcohols. In one particular embodiment, for example, an aliphatic-aromatic copolyester is formed during the alcoholysis reaction that comprises the following general structure:

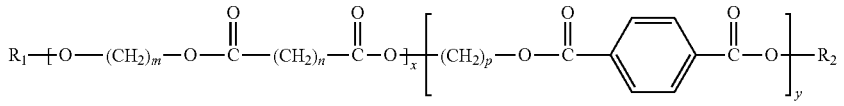

wherein, m is an integer from 2 to 10, in some embodiments from 2 to 4, and in one embodiment, 4;

n is an integer from 0 to 18, in some embodiments from 2 to 4, and in one embodiment, 4;

p is an integer from 2 to 10, in some embodiments from 2 to 4, and in one embodiment, 4;

x is an integer greater than 1;

y is an integer greater than 1; and $R_1$ and $R_2$ are independently selected from hydrogen; hydroxyl groups; straight chain or branched, substituted or unsubstituted $C_1$-$C_{10}$ alkyl groups; straight chain or branched, substituted or unsubstituted $C_1$-$C_{10}$ hydroxyalkyl groups. Preferably, at least one of $R_1$ and $R_2$, or both, are straight chain or branched, substituted or unsubstituted, $C_1$-$C_{10}$ alkyl or $C_1$-$C_{10}$ hydroxyalkyl groups, in some embodiments $C_1$-$C_8$ alkyl or $C_1$-$C_8$ hydroxyalkyl groups, and in some embodiments, $C_2$-$C_6$ alkyl or $C_2$-$C_6$ hydroxyalkyl groups. Examples of suitable alkyl and hydroxyalkyl groups include, for instance, methyl, ethyl, iso-propyl, n-propyl, n-butyl, isobutyl, sec-butyl, tert-butyl, n-pentyl, n-hexyl, n-heptyl, n-octyl, n-decyl, 1-hydroxyethyl, 2-hydroxyethyl, 3-hydroxypropyl, 4-hydroxybutyl, and 5-hydroxypentyl groups. Thus, as indicated, the modified aliphatic-aromatic copolyester has a different chemical composition than an unmodified copolyester in terms of its terminal groups. The terminal groups may play a substantial role in determining the properties of the polymer, such as its reactivity, stability, etc.

Regardless of its particular structure, a new polymer species is formed during alcoholysis that has a molecular weight lower than that of the starting polyester. The weight average and/or number average molecular weights may, for instance, each be reduced so that the ratio of the starting copolyester molecular weight to the new molecular weight is at least about 1.1, in some embodiments at least about 1.4, and in some embodiments, at least about 1.6. For example, the modified aliphatic-aromatic copolyester may have a number average molecular weight ("$M_n$") ranging from about 10,000 to about 70,000 grams per mole, in some embodiments from about 20,000 to about 60,000 grams per mole, and in some embodiments, from about 30,000 to about 55,000 grams per mole. Likewise, the modified copolyester may also have a weight average molecular weight ("$M_w$") of from about 20,000 to about 125,000 grams per mole, in some embodiments from about 30,000 to about 110,000 grams per mole, and in some embodiments, from about 40,000 to about 90,000 grams per mole.

In addition to possessing a lower molecular weight, the modified aliphatic-aromatic copolyester may also have a lower apparent viscosity and higher melt flow index than the starting polyester. The apparent viscosity may for instance, be reduced so that the ratio of the starting copolyester viscosity to the modified copolyester viscosity is at least about 1.1, in some embodiments at least about 2, and in some embodiments, from about 10 to about 40. Likewise, the melt flow index may be increased so that the ratio of the modified copolyester melt flow index to the starting copolyester melt flow index is at least about 1.5, in some embodiments at least about 3, in some embodiments at least about 10, and in some embodiments, from about 20 to about 200. In one particular embodiment, the modified copolyester may have an apparent viscosity of from about 25 to about 500 Pascal seconds (Pa·s), in some embodiments from about 50 to about 400 Pa·s, and in some embodiments, from about 100 to about 300 Pa·s, as determined at a temperature of 150° C. and a shear rate of 1000 $sec^{-1}$. The melt flow index (190° C., 2.16 kg) of the modified copolyester may range from about 5 to about 200 grams per 10 minutes, in some embodiments from about 10 to about 100 grams per 10 minutes, and in some embodiments, from about 15 to about 50 grams per 10 minutes. Of course, the extent to which the molecular weight, apparent viscosity, and/or melt flow index are altered by the alcoholysis reaction may vary depending on the intended application.

Although differing from the starting polymer in certain properties, the modified copolyester may nevertheless retain other properties of the starting polymer to enhance the flexibility and processability of the polymers. For example, the thermal characteristics (e.g., $T_g$, $T_m$, and latent heat of fusion) typically remain substantially the same as the starting polymer, such as within the ranges noted above. Further, even though the actual molecular weights may differ, the polydispersity index of the modified copolyester may remain substantially the same as the starting polymer, such as within the range of about 1.0 to about 3.0, in some embodiments from about 1.1 to about 2.0, and in some embodiments, from about 1.2 to about 1.8.

If desired, a catalyst may be employed to facilitate the modification of the alcoholysis reaction. The concentration of the catalyst may influence the extent to which the molecular weight is altered. For instance, higher catalyst concentrations generally result in a more significant decrease in molecular weight. Of course, too high of a catalyst concentration may also affect the physical characteristics of the resulting polymer. Thus, in most embodiments, the catalyst(s) are employed in an amount of about 50 to about 2000 parts per million ("ppm"), in some embodiments from about 100 to about 1000 ppm, and in some embodiments, from about 200 to about 1000 ppm, based on the weight of the starting aliphatic-aromatic copolyester.

Any known catalyst may be used in the present invention to accomplish the desired reaction. In one embodiment, for example, a transition metal catalyst may be employed, such as those based on Group IVB metals and/or Group IVA metals (e.g., alkoxides or salts). Titanium-, zirconium-, and/or tin-based metal catalysts are especially desirable and may include, for instance, titanium butoxide, titanium tetrabutoxide, titanium propoxide, titanium isopropoxide, titanium phenoxide, zirconium butoxide, dibutyltin oxide, dibutyltin diacetate, tin phenoxide, tin octylate, tin stearate, dibutyltin dioctoate, dibutyltin dioleylmaleate, dibutyltin dibutylmaleate, dibutyltin dilaurate, 1,1,3,3-tetrabutyl-1,3-dilauryloxycarbonyldistannoxane, dibutyltindiacetate, dibutyltin diacetylacetonate, dibutyltin bis(o-phenylphenoxide), dibutyltin bis(triethoxysilicate), dibutyltin distearate, dibutyltin bis(isononyl-3-mercaptopropionate), dibutyltin bis(isooctyl thioglycolate), dioctyltin oxide, dioctyltin dilaurate, dioctyltin diacetate, and dioctyltin diversatate.

The alcoholysis reaction is typically carried out in the absence of a solvent other than the alcohol reactant. Nevertheless, a co-solvent may be employed in some embodiments of the present invention. In one embodiment, for instance, the co-solvent may facilitate the dispersion of the catalyst in the reactant alcohol. Examples of suitable co-solvents may include ethers, such as diethyl ether, anisole, tetrahydrofuran, ethylene glycol dimethyl ether, triethylene glycol dimethyl ether, tetraethylene glycol dimethyl ether, dioxane, etc.; alcohols, such as methanol, ethanol, n-butanol, benzyl alcohol, ethylene glycol, diethylene glycol, etc.; phenols, such as phenol, etc.; carboxylic acids, such as formic acid, acetic acid, propionic acid, toluic acid, etc.; esters, such as methyl acetate, butyl acetate, benzyl benzoate, etc.; aromatic hydrocarbons, such as benzene, toluene, ethylbenzene, tetralin, etc.; aliphatic hydrocarbons, such as n-hexane, n-octane, cyclohexane, etc.; halogenated hydrocarbons, such as dichloromethane, trichloroethane, chlorobenzene, etc.; nitro compounds, such as nitromethane, nitrobenzene, etc.; carbamides, such as N,N-dimethylformamide, N,N-dimethylacetamide, N-methylpyrrolidone, etc.; ureas, such as N,N-dimethylimidazolidinone, etc.; sulfones, such as dimethyl sulfone, etc.; sulfoxides, such as dimethyl sulfoxide, etc.; lactones, such as butyrolactone, caprolactone, etc.; carbonic acid esters, such as dimethyl carbonate, ethylene carbonate, etc.; and so forth.

When employed, the co-solvent(s) may be employed in an amount from about 0.5 wt. % to about 20 wt. %, in some embodiments from about 0.8 wt. % to about 10 wt. %, and in some embodiments, from about 1 wt. % to about 5 wt. %, based on the weight of the reactive composition. It should be understood, however, that a co-solvent is not required. In fact, in some embodiments of the present invention, the reactive composition is substantially free of any co-solvents, e.g., less than about 0.5 wt. % of the reactive composition.

The alcoholysis reaction may be performed using any of a variety of known techniques. In one embodiment, for example, the reaction is conducted while the starting polyester is in the melt phase ("melt blending") to minimize the need for additional solvents and/or solvent removal processes. The raw materials (e.g., biodegradable polymer, alcohol, catalyst, etc.) may be supplied separately or in combination (e.g., in a solution). The raw materials may likewise be supplied either simultaneously or in sequence to a melt-blending device that dispersively blends the materials. Batch and/or continuous melt blending techniques may be employed. For example, a mixer/kneader, Banbury mixer, Farrel continuous mixer, single-screw extruder, twin-screw extruder, roll mill, etc., may be utilized to blend the materials. One particularly suitable melt-blending device is a co-rotating, twin-screw extruder (e.g., ZSK-30 twin-screw extruder available from Werner & Pfleiderer Corporation of Ramsey, N.J.). Such extruders may include feeding and venting ports and provide high intensity distributive and dispersive mixing, which facilitate the alcoholysis reaction. For example, the polyester may be fed to a feeding port of the twin-screw extruder and melted. Thereafter, the alcohol may be injected into the polymer melt. Alternatively, the alcohol may be separately fed into the extruder at a different point along its length. The catalyst, a mixture of two or more catalysts, or catalyst solutions may be injected separately or in combination with the alcohol or a mixture of two or more alcohols to the polymer melt.

Regardless of the particular melt blending technique chosen, the raw materials are blended under high shear/pressure and heat to ensure sufficient mixing for initiating the alcoholysis reaction. For example, melt blending may occur at a temperature of from about 50° C. to about 300° C., in some embodiments, from about 70° C. to about 250° C., and in some embodiments, from about 90° C. to about 180° C. Likewise, the apparent shear rate during melt blending may range from about 100 $seconds^{-1}$ to about 10,000 $seconds^{-1}$, in some embodiments from about 500 $seconds^{-1}$ to about 5000 $seconds^{-1}$, and in some embodiments, from about 800 $seconds^{-1}$ to about 1200 $seconds^{-1}$. The apparent shear rate is equal to $4\ Q/\pi\ R^3$, where Q is the volumetric flow rate ("$m^3/s$") of the polymer melt and R is the radius ("m") of the capillary (e.g., extruder die) through which the melted polymer flows.

B. Thermoplastic Starch

In addition to a modified aliphatic-aromatic copolyester, a thermoplastic starch is employed in the present invention. Starch is a natural polymer composed of amylose and amylopectin. Amylose is essentially a linear polymer having a molecular weight in the range of 100,000-500,000, whereas amylopectin is a highly branched polymer having a molecular weight of up to several million. Although starch is produced in many plants, typical sources includes seeds of cereal grains, such as corn, waxy corn, wheat, sorghum, rice, and waxy rice; tubers, such as potatoes; roots, such as tapioca (i.e., cassava and manioc), sweet potato, and arrowroot; and the pith of the sago palm. Broadly speaking, any natural (unmodified) and/or modified starch may be employed in the present invention. Modified starches, for instance, are often employed that have been chemically modified by typical processes known in the art (e.g., esterification, etherification, oxidation, acid hydrolysis, enzymatic hydrolysis, etc.). Starch ethers and/or esters may be particularly desirable, such as hydroxyalkyl starches, carboxymethyl starches, etc. The hydroxyalkyl group of hydroxylalkyl starches may contain, for instance, 2 to 10 carbon atoms, in some embodiments from 2 to 6 carbon atoms, and in some embodiments, from 2 to 4 carbon atoms. Representative hydroxyalkyl starches such as hydroxyethyl starch, hydroxypropyl starch, hydroxybutyl starch, and derivatives thereof. Starch esters, for instance, may be prepared using a wide variety of anhydrides (e.g., acetic, propionic, butyric, and so forth), organic acids, acid chlorides, or other esterification reagents. The degree of esterification may vary as desired, such as from 1 to 3 ester groups per glucosidic unit of the starch.

Regardless of whether it is in a native or modified form, the starch may contain different percentages of amylose and amylopectin, different size starch granules and different polymeric weights for amylose and amylopectin. High amylose starches contain greater than about 50% by weight amylose and low amylose starches contain less than about 50% by weight amylose. Although not required, low amylose starches having an amylose content of from about 10% to about 40% by weight, and in some embodiments, from about 15% to about 35% by weight, are particularly suitable for use in the present invention. Examples of such low amylose starches include corn starch and potato starch, both of which have an amylose content of approximately 20% by weight. Such low amylose starches typically have a number average molecular weight ("$M_n$") ranging from about 50,000 to about 1,000,000 grams per mole, in some embodiments from about 75,000 to about 800,000 grams per mole, and in some embodiments, from about 100,000 to about 600,000 grams per mole, as well as a weight average molecular weight ("$M_w$") ranging from about 5,000,000 to about 25,000,000 grams per mole, in some embodiments from about 5,500,000 to about 15,000,000 grams per mole, and in some embodiments, from about 6,000,000 to about 12,000,000 grams per mole. The ratio of the weight average molecular weight to the number average molecular weight ("$M_w/M_n$"), i.e., the "polydispersity index", is also relatively high. For example, the polydispersity index may range from about 20 to about 100.

A plasticizer is also employed in the thermoplastic starch to help render the starch melt-processible. Starches, for instance, normally exist in the form of granules that have a coating or outer membrane that encapsulates the more water-soluble amylose and amylopectin chains within the interior of the granule. When heated, plasticizers may soften and penetrate the outer membrane and cause the inner starch chains to absorb water and swell. This swelling will, at some point, cause the outer shell to rupture and result in an irreversible destructurization of the starch granule. Once destructurized, the starch polymer chains containing amylose and amylopectin polymers, which are initially compressed within the granules, will stretch out and form a generally disordered intermingling of polymer chains. Upon resolidification, however, the chains may reorient themselves to form crystalline or amorphous solids having varying strengths depending on the orientation of the starch polymer chains. Because the starch is thus capable of melting and resolidifying at certain temperatures, it is generally considered a "thermoplastic starch."

Suitable plasticizers may include, for instance, polyhydric alcohol plasticizers, such as sugars (e.g., glucose, sucrose, fructose, raffinose, maltodextrose, galactose, xylose, maltose, lactose, mannose, and erythrose), sugar alcohols (e.g., erythritol, xylitol, malitol, mannitol, and sorbitol), polyols (e.g., ethylene glycol, glycerol, propylene glycol, dipropylene glycol, butylene glycol, and hexane triol), etc. Also suitable are hydrogen bond forming organic compounds which do not have hydroxyl group, including urea and urea derivatives; anhydrides of sugar alcohols such as sorbitan; animal proteins such as gelatin; vegetable proteins such as sunflower protein, soybean proteins, cotton seed proteins; and mixtures thereof. Other suitable plasticizers may include phthalate esters, dimethyl and diethylsuccinate and related esters, glycerol triacetate, glycerol mono and diacetates, glycerol mono, di, and tripropionates, butanoates, stearates, lactic acid esters, citric acid esters, adipic acid esters, stearic acid esters, oleic acid esters, and other acid esters. Aliphatic acids may also be used, such as copolymers of ethylene and acrylic acid, polyethylene grafted with maleic acid, polybutadiene-co-acrylic acid, polybutadiene-co-maleic acid, polypropylene-co-acrylic acid, polypropylene-co-maleic acid, and other hydrocarbon based acids. A low molecular weight plasticizer is preferred, such as less than about 20,000 g/mol, preferably less than about 5,000 g/mol and more preferably less than about 1,000 g/mol.

The relative amount of starches and plasticizers employed in the thermoplastic starch may vary depending on a variety of factors, such as the desired molecular weight, the type of starch, the affinity of the plasticizer for the starch, etc. Typically, however, starches constitute from about 30 wt. % to about 95 wt. %, in some embodiments from about 40 wt. % to about 90 wt. %, and in some embodiments, from about 50 wt. % to about 85 wt. % of the thermoplastic starch. Likewise, plasticizers typically constitute from about 5 wt. % to about 55 wt. %, in some embodiments from about 10 wt. % to about 45 wt. %, and in some embodiments, from about 15 wt. % to about 35 wt. % of the thermoplastic composition. It should be understood that the weight of starch referenced herein includes any bound water that naturally occurs in the starch before mixing it with other components to form the thermoplastic starch. Starches, for instance, typically have a bound water content of about 5% to 16% by weight of the starch.

Of course, other additives may also be employed in the thermoplastic starch to facilitate its use in various types of fibers. Dispersion aids, for instance, may be employed to help create a uniform dispersion of the starch/plasticizer mixture and retard or prevent separation of the thermoplastic starch into constituent phases. When employed, the dispersion aid(s) typically constitute from about 0.01 wt. % to about 10 wt. %, in some embodiments from about 0.1 wt. % to about 5 wt. %, and in some embodiments, from about 0.5 wt. % to about 4 wt. % of the thermoplastic starch.

Although any dispersion aid may generally be employed in the present invention, surfactants having a certain hydrophilic/lipophilic balance ("HLB") may improve the long-term stability of the composition. The HLB index is well known in the art and is a scale that measures the balance between the hydrophilic and lipophilic solution tendencies of a compound. The HLB scale ranges from 1 to approximately 50, with the lower numbers representing highly lipophilic tendencies and the higher numbers representing highly hydrophilic tendencies. In some embodiments of the present invention, the HLB value of the surfactants is from about 1 to about 20, in some embodiments from about 1 to about 15 and in some embodiments, from about 2 to about 10. If desired, two or more surfactants may be employed that have HLB values either below or above the desired value, but together have an average HLB value within the desired range.

One particularly suitable class of surfactants for use in the present invention are nonionic surfactants, which typically have a hydrophobic base (e.g., long chain alkyl group or an alkylated aryl group) and a hydrophilic chain (e.g., chain containing ethoxy and/or propoxy moieties). For instance, some suitable nonionic surfactants that may be used include, but are not limited to, ethoxylated alkylphenols, ethoxylated and propoxylated fatty alcohols, polyethylene glycol ethers of methyl glucose, polyethylene glycol ethers of sorbitol, ethylene oxide-propylene oxide block copolymers, ethoxylated esters of fatty ($C_8$-$C_{18}$) acids, condensation products of ethylene oxide with long chain amines or amides, condensation products of ethylene oxide with alcohols, fatty acid esters, monoglyceride or diglycerides of long chain alcohols, and mixtures thereof. In one particular embodiment, the nonionic surfactant may be a fatty acid ester, such as a sucrose fatty acid ester, glycerol fatty acid ester, propylene glycol fatty acid ester, sorbitan fatty acid ester, pentaerythritol fatty acid ester, sorbitol fatty acid ester, and so forth. The fatty acid used to form such esters may be saturated or unsaturated, substituted or unsubstituted, and may contain from 6 to 22 carbon atoms, in some embodiments from 8 to 18 carbon atoms, and in some embodiments, from 12 to 14 carbon atoms. In one particular embodiment, mono- and di-glycerides of fatty acids may be employed in the present invention.

Regardless of the particular manner in which it is formed, the thermoplastic starch typically has an apparent viscosity that is similar in nature to the modified copolyester. For example, the thermoplastic starch may have an apparent viscosity of from about 25 to about 500 Pascal seconds (Pa·s), in some embodiments from about 50 to about 400 Pa·s, and in some embodiments, from about 100 to about 300 Pa·s, as determined at a temperature of 150° C. and a shear rate of 1000 $sec^{-1}$. The melt flow index (190° C., 2.16 kg) of the thermoplastic starch may also range from about 0.05 to about 50 grams per 10 minutes, in some embodiments from about 0.1 to about 15 grams per 10 minutes, and in some embodiments, from about 0.5 to about 5 grams per 10 minutes.

C. Other Components

Other components may of course be utilized for a variety of different reasons. For instance, materials that may be used include, without limitation, wetting agents, melt stabilizers, processing stabilizers, heat stabilizers, light stabilizers, antioxidants, pigments, surfactants, waxes, flow promoters or melt flow rate modifiers, particulates, nucleating agents, and other materials added to enhance processability. For example, a nucleating agent may be employed if desired to improve processing and to facilitate crystallization during quenching. Suitable nucleating agents for use in the present invention may include, for instance, inorganic acids, carbonates (e.g., calcium carbonate or magnesium carbonate), oxides (e.g., titanium oxide, silica, or alumina), nitrides (e.g., boron nitride), sulfates (e.g., barium sulfate), silicates (e.g., calcium silicate), stearates, benzoates, carbon black, graphite, and so forth. When employed, the amount of each additive may be selectively controlled to achieve the desired properties for the fibers. For example, an additive may be present in an amount of about 0.1 wt. % to about 25 wt. %, in some embodiments from about 0.2 wt. % to about 15 wt. %, in some embodiments from about 0.5 wt. % to about 10 wt. %, and in some embodiments, from about 1 wt. % to about 5 wt. %, based on the dry weight of the thermoplastic composition.

II. Fiber Formation

Fibers formed from the thermoplastic composition may generally have any desired configuration, including monocomponent, multicomponent (e.g., sheath-core configuration, side-by-side configuration, segmented pie configuration, island-in-the-sea configuration, and so forth), and/or multiconstituent (e.g., polymer blend). In some embodiments, the fibers may contain one or more additional polymers as a component (e.g., bicomponent) or constituent (e.g., biconstituent) to further enhance strength and other mechanical properties. For instance, the thermoplastic composition may form a sheath component of a sheath/core bicomponent fiber, while an additional polymer may form the core component, or vice versa. The additional polymer may be a thermoplastic polymer that is not generally considered biodegradable, such as polyolefins, e.g., polyethylene, polypropylene, polybutylene, and so forth; polytetrafluoroethylene; polyesters, e.g., polyethylene terephthalate, and so forth; polyvinyl acetate; polyvinyl chloride acetate; polyvinyl butyral; acrylic resins, e.g., polyacrylate, polymethylacrylate, polymethylmethacrylate, and so forth; polyamides, e.g., nylon; polyvinyl chloride; polyvinylidene chloride; polystyrene; polyvinyl alcohol; and polyurethanes. More desirably, however, the additional polymer is biodegradable, such as aliphatic polyesters, such as polyesteramides, modified polyethylene terephthalate, polylactic acid (PLA) and its copolymers, terpolymers based on polylactic acid, polyglycolic acid, polyalkylene carbonates (such as polyethylene carbonate), polyhydroxyalkanoates (PHA), polyhydroxybutyrates (PHB), polyhydroxyvalerates (PHV), polyhydroxybutyrate-hydroxyvalerate copolymers (PHBV), and polycaprolactone, and succinate-based aliphatic polymers (e.g., polybutylene succinate, polybutylene succinate adipate, and polyethylene succinate); or other aliphatic-aromatic copolyesters.

Any of a variety of processes may be used to form fibers in accordance with the present invention. For example, the melt processed thermoplastic composition described above may be extruded through a spinneret, quenched, and drawn into the vertical passage of a fiber draw unit. The fibers may then be cut to form staple fibers having an average fiber length in the range of from about 3 to about 80 millimeters, in some embodiments from about 4 to about 65 millimeters, and in some embodiments, from about 5 to about 50 millimeters. The staple fibers may then be incorporated into a nonwoven web as is known in the art, such as bonded carded webs, through-air bonded webs, etc. The fibers may also be deposited onto a foraminous surface to form a nonwoven web.

Referring to FIG. 1, for example, one embodiment of a method for forming spunbond fibers is shown. In FIG. 1, for instance, the raw materials (e.g., thermoplastic starch and modified aliphatic-aromatic polyester) are fed into an extruder 12 from a hopper 14. The raw materials may be provided to the hopper 14 using any conventional technique and in any state. The extruder 12 is driven by a motor (not shown) and heated to a temperature sufficient to extrude the melted polymer. For example, the extruder 12 may employ one or multiple zones operating at a temperature that is high enough to raise the temperature of the starch and copolyester above their melting point, yet low enough to avoid substantial removal of the moisture found in the starch. Typically, the melt processing temperature ranges from about 60° C. to about 180° C., in some embodiments from about 70° C. to about 170° C., and in some embodiments, from about 80° C. to about 160° C. Typical shear rates range from about 100 $seconds^{-1}$ to about 10,000 $seconds^{-1}$, in some embodiments from about 500 seconds$^{-1}$ to about 5000 seconds$^{-1}$, and in some embodiments, from about 800 seconds$^{-1}$ to about 1200 seconds$^{-1}$. If desired, the extruder may also possess one or more zones that remove excess moisture from the polymer, such as vacuum zones, etc. The extruder may also be vented to allow volatile gases to escape.

Once formed, the thermoplastic composition may be subsequently fed to another extruder in a fiber formation line. Alternatively, as shown in FIG. 1, the thermoplastic composition may be directly formed into a fiber through a polymer conduit 16 to a spinneret 18. Spinnerets for extruding multicomponent filaments are well known to those of skill in the art. For example, the spinneret 18 may include a housing containing a spin pack having a plurality of plates stacked one on top of each other and having a pattern of openings arranged to create flow paths for directing polymer components. The spinneret 18 also has openings arranged in one or more rows. The openings form a downwardly extruding curtain of filaments when the polymers are extruded therethrough. The process 10 also employs a quench blower 20 positioned adjacent the curtain of filaments extending from the spinneret 18. Air from the quench air blower 20 quenches the filaments extending from the spinneret 18. The quench air may be directed from one side of the filament curtain as shown in FIG. 1 or both sides of the filament curtain. A fiber draw unit or aspirator 22 is positioned below the spinneret 18 and receives the quenched filaments. Fiber draw units or aspirators for use in melt spinning polymers are well-known in the art. Suitable fiber draw units for use in the process of the present invention include a linear fiber aspirator of the type shown in U.S. Pat. Nos. 3,802,817 and 3,423,255, which are incorporated herein in their entirety by reference thereto for all relevant purposes. The fiber draw unit 22 generally includes an elongate vertical passage through which the filaments are drawn by aspirating air entering from the sides of the passage and flowing downwardly through the passage. A heater or blower 24 supplies aspirating air to the fiber draw unit 22. The aspirating air draws the filaments and ambient air through the fiber draw unit 22. Thereafter, the filaments are formed into a coherent web structure by randomly depositing the filaments onto a forming surface 26 (optionally with the aid of a vacuum) and then bonding the resulting web using any known technique.

After quenching, the filaments are drawn into the vertical passage of the fiber draw unit 22 by a flow of a gas such as air, from the heater or blower 24 through the fiber draw unit. The flow of gas causes the filaments to draw or attenuate which increases the molecular orientation or crystallinity of the polymers forming the filaments. The filaments are deposited through the outlet opening of the fiber draw unit 22 and onto a godet roll 42. Due to the high strength of the filaments of the present invention, high draw down ratios may be employed in the present invention. The draw down ratio is the linear speed of the filaments after drawing (e.g., linear speed of the godet roll 42 or a foraminous surface (not shown) divided by the linear speed of the filaments after extrusion. For example, the draw ratio may be calculated in certain embodiments as follows:

$$\text{Draw Ratio}=A/B$$

wherein,

A is the linear speed of the fiber after drawing (i.e., godet speed) and is directly measured; and B is the linear speed of the extruded fiber and can be calculated as follows:

$$\text{Extruder linear fiber speed}=C/(25*\pi*D*E^2)$$

wherein,

C is the throughput through a single hole (grams per minute);

D is the density of the polymer (grams per cubic centimeter); and

E is the diameter of the orifice (in centimeters) through which the fiber is extruded. In certain embodiments of the present invention, the draw ratio may be from about 200:1 to about 6500:1, in some embodiments from about 500:1 to about 6000:1, and in some embodiments, from about 1000:1 to about 5000:1.

If desired, the fibers collected on the godet roll 42 may optionally be subjected to additional in line processing and/or converting steps (not shown) as will be understood by those skilled in the art. For example, staple fibers may be formed by "cold drawing" the collected fibers at a temperature below their softening temperature to the desired diameter, and thereafter crimping, texturizing, and/or and cutting the fibers to the desired fiber length.

Regardless of the particular manner in which they are formed, the present inventors have discovered that the resulting fibers exhibit excellent strength characteristics. One parameter that is indicative of the relative strength of the fibers of the present invention is "tenacity", which indicates the tensile strength of a fiber expressed as force per unit linear density. For example, the fibers of the present invention may have a tenacity of from about 0.2 to about 1.5 grams-force ("$g_f$") per denier, in some embodiments from about 0.4 to about 1.2 $g_f$ per denier, and in some embodiments, from about 0.5 to about 1.0 $g_f$ per denier. Furthermore, the fibers of the present invention also have a relatively high "peak tensile stress", which indicates the maximum tensile stress expressed in force per unit area. For example, the fibers of the present invention may have a peak tensile stress of from about 15 to about 200 Megapascals (MPa), in some embodiments from about 25 to about 150 MPa, and in some embodiments, from about 50 to about 100 MPa.

If desired, the fibers may also be directly formed into a coherent web structure by randomly depositing the fibers onto a forming surface (optionally with the aid of a vacuum) and then bonding the resulting web using any known technique. For example, an endless foraminous forming surface may be positioned below the fiber draw unit and receive the filaments from an outlet opening. A vacuum may be positioned below the forming surface to draw the filaments and consolidate the unbonded nonwoven web. Once formed, the nonwoven web may then be bonded using any conventional technique, such as with an adhesive or autogenously (e.g., fusion and/or self-adhesion of the fibers without an applied external adhesive). Autogenous bonding, for instance, may be achieved through contact of the fibers while they are semi-molten or tacky, or simply by blending a tackifying resin and/or solvent with the polymer(s) used to form the fibers. Suitable autogenous bonding techniques may include ultrasonic bonding, thermal bonding, through-air bonding, calendar bonding, and so forth. For example, the web may be further bonded or embossed with a pattern by a thermomechanical process in which the web is passed between a heated smooth anvil roll and a heated pattern roll. The pattern roll may have any raised pattern which provides the desired web properties or appearance. Desirably, the pattern roll defines a raised pattern which defines a plurality of bond locations which define a bond area between about 2% and 30% of the total area of the roll. Exemplary bond patterns include, for instance, those described in U.S. Pat. No. 3,855,046 to Hansen et al., U.S. Pat. No. 5,620,779 to Levy et al., U.S. Pat. No. 5,962,112 to Haynes et al., U.S. Pat. No. 6,093, 665 to Sayovitz et al., as well as U.S. Design Pat. No. 428,267 to Romano et al.; U.S. Pat. No. 390,708 to Brown; U.S. Pat. No. 418,305 to Zander, et al.; U.S. Pat. No. 384,508 to Zander, et al.; U.S. Pat. No. 384,819 to Zander, et al.; U.S. Pat. No. 358,035 to Zander, et al.; and U.S. Pat. No. 315,990 to Blenke, et al., all of which are incorporated herein in their entirety by reference thereto for all purposes. The pressure between the rolls may be from about 5 to about 2000 pounds per lineal inch. The pressure between the rolls and the temperature of the rolls is balanced to obtain desired web properties or appearance while maintaining cloth like properties. As is well known to those skilled in the art, the temperature and pressure required may vary depending upon many factors including but not limited to, pattern bond area, polymer properties, fiber properties and nonwoven properties.

In addition to spunbond webs, a variety of other nonwoven webs may also be formed from the thermoplastic composition in accordance with the present invention, such as meltblown webs, bonded carded webs, wet-laid webs, airlaid webs, coform webs, hydraulically entangled webs, etc. For example, the thermoplastic composition may be extruded through a plurality of fine die capillaries into a converging high velocity gas (e.g., air) streams that attenuate the fibers to reduce their diameter. Thereafter, the meltblown fibers are carried by the high velocity gas stream and are deposited on a collecting surface to form a web of randomly dispersed meltblown fibers. Alternatively, the polymer may be formed into a carded web by placing bales of fibers formed from the thermoplastic composition into a picker that separates the fibers. Next, the fibers are sent through a combing or carding unit that further breaks apart and aligns the fibers in the machine direction so as to form a machine direction-oriented fibrous nonwoven web. Once formed, the nonwoven web is typically stabilized by one or more known bonding techniques.

If desired, the nonwoven web may also be a composite that contains a combination of the thermoplastic composition fibers and other types of fibers (e.g., staple fibers, filaments, etc). For example, additional synthetic fibers may be utilized, such as those formed from polyolefins, e.g., polyethylene, polypropylene, polybutylene, and so forth; polytetrafluoroethylene; polyesters, e.g., polyethylene terephthalate and so forth; polyvinyl acetate; polyvinyl chloride acetate; polyvinyl butyral; acrylic resins, e.g., polyacrylate, polymethylacrylate, polymethylmethacrylate, and so forth; polyamides, e.g., nylon; polyvinyl chloride; polyvinylidene chloride; polystyrene; polyvinyl alcohol; polyurethanes; polylactic acid; etc. If desired, biodegradable polymers, such as poly(glycolic acid) (PGA), poly(lactic acid) (PLA), poly(β-malic acid) (PMLA), poly(ε-caprolactone) (PCL), poly(ρ-dioxanone) (PDS), poly (butylene succinate) (PBS), and poly(3-hydroxybutyrate) (PHB), may also be employed. Some examples of known synthetic fibers include sheath-core bicomponent fibers available from KoSa Inc. of Charlotte, N.C. under the designations T-255 and T-256, both of which use a polyolefin sheath, or T-254, which has a low melt co-polyester sheath. Still other known bicomponent fibers that may be used include those available from the Chisso Corporation of Moriyama, Japan or Fibervisions LLC of Wilmington, Del. Polylactic acid staple fibers may also be employed, such as those commercially available from Far Eastern Textile, Ltd. of Taiwan.

The composite may also contain pulp fibers, such as high-average fiber length pulp, low-average fiber length pulp, or mixtures thereof. One example of suitable high-average length fluff pulp fibers includes softwood kraft pulp fibers. Softwood kraft pulp fibers are derived from coniferous trees and include pulp fibers such as, but not limited to, northern, western, and southern softwood species, including redwood, red cedar, hemlock, Douglas fir, true firs, pine (e.g., southern pines), spruce (e.g., black spruce), bamboo, combinations thereof, and so forth. Northern softwood kraft pulp fibers may be used in the present invention. An example of commercially available southern softwood kraft pulp fibers suitable for use in the present invention include those available from Weyerhaeuser Company with offices in Federal Way, Wash. under the trade designation of "NF-405." Another suitable pulp for use in the present invention is a bleached, sulfate wood pulp containing primarily softwood fibers that is available from Bowater Corp. with offices in Greenville, S.C. under the trade name CoosAbsorb S pulp. Low-average length fibers may also be used in the present invention. An example of suitable low-average length pulp fibers is hardwood kraft pulp fibers. Hardwood kraft pulp fibers are derived from deciduous trees and include pulp fibers such as, but not limited to, eucalyptus, maple, birch, aspen, etc. Eucalyptus kraft pulp fibers may be particularly desired to increase softness, enhance brightness, increase opacity, and change the pore structure of the sheet to increase its wicking ability. Bamboo or cotton fibers may also be employed.

Nonwoven composites may be formed using a variety of known techniques. For example, the nonwoven composite may be a "coform material" that contains a mixture or stabilized matrix of the thermoplastic composition fibers and an absorbent material. As an example, coform materials may be made by a process in which at least one meltblown die head is arranged near a chute through which the absorbent materials are added to the web while it is forming. Such absorbent materials may include, but are not limited to, pulp fibers, superabsorbent particles, inorganic and/or organic absorbent materials, treated polymeric staple fibers, and so forth. The relative percentages of the absorbent material may vary over a wide range depending on the desired characteristics of the nonwoven composite. For example, the nonwoven composite may contain from about 1 wt. % to about 60 wt. %, in some embodiments from 5 wt. % to about 50 wt. %, and in some embodiments, from about 10 wt. % to about 40 wt. % thermoplastic composition fibers. The nonwoven composite may likewise contain from about 40 wt. % to about 99 wt. %, in some embodiments from 50 wt. % to about 95 wt. %, and in some embodiments, from about 60 wt. % to about 90 wt. % absorbent material. Some examples of such coform materials are disclosed in U.S. Pat. No. 4,100,324 to Anderson, et al.; U.S. Pat. No. 5,284,703 to Everhart, et al.; and U.S. Pat. No. 5,350,624 to Georger, et al.; which are incorporated herein in their entirety by reference thereto for all purposes.

Nonwoven laminates may also be formed in the present invention in which one or more layers are formed from the thermoplastic composition. For example, the nonwoven web of one layer may be a spunbond that contains the thermoplastic composition, while the nonwoven web of another layer contains thermoplastic composition, other biodegradable polymer(s), and/or any other polymer (e.g., polyolefins). In one embodiment, the nonwoven laminate contains a meltblown layer positioned between two spunbond layers to form a spunbond/meltblown/spunbond ("SMS") laminate. If desired, the spunbond layer(s) may be formed from the thermoplastic composition. The meltblown layer may be formed from the thermoplastic composition, other biodegradable polymer(s), and/or any other polymer (e.g., polyolefins). Various techniques for forming SMS laminates are described in U.S. Pat. No. 4,041,203 to Brock et al.; U.S. Pat. No. 5,213,881 to Timmons, et al.; U.S. Pat. No. 5,464,688 to Timmons, et al.; U.S. Pat. No. 4,374,888 to Bornslaeger; U.S. Pat. No. 5,169,706 to Collier, et al.; and U.S. Pat. No. 4,766,029 to Brock et al., as well as U.S. Patent Application Publication No. 2004/0002273 to Fitting, et al., all of which are incorporated herein in their entirety by reference thereto for all purposes. Of course, the nonwoven laminate may have other configuration and possess any desired number of meltblown and spunbond layers, such as spunbond/meltblown/meltblown/spunbond laminates ("SMMS"), spunbond/meltblown laminates ("SM"), etc. Although the basis weight of the nonwoven laminate may be tailored to the desired application, it generally ranges from about 10 to about 300 grams per square meter ("gsm"), in some embodiments from about 25 to about 200 gsm, and in some embodiments, from about 40 to about 150 gsm.

If desired, the nonwoven web or laminate may be applied with various treatments to impart desirable characteristics. For example, the web may be treated with liquid-repellency additives, antistatic agents, surfactants, colorants, antifogging agents, fluorochemical blood or alcohol repellents, lubricants, and/or antimicrobial agents. In addition, the web may be subjected to an electret treatment that imparts an electrostatic charge to improve filtration efficiency. The charge may include layers of positive or negative charges trapped at or near the surface of the polymer, or charge clouds stored in the bulk of the polymer. The charge may also include polarization charges that are frozen in alignment of the dipoles of the molecules. Techniques for subjecting a fabric to an electret treatment are well known by those skilled in the art. Examples of such techniques include, but are not limited to, thermal, liquid-contact, electron beam and corona discharge techniques. In one particular embodiment, the electret treatment is a corona discharge technique, which involves subjecting the laminate to a pair of electrical fields that have opposite polarities. Other methods for forming an electret material are described in U.S. Pat. No. 4,215,682 to Kubik, et al.; U.S. Pat. No. 4,375,718 to Wadsworth; U.S. Pat. No. 4,592,815 to Nakao; U.S. Pat. No. 4,874,659 to Ando; U.S. Pat. No. 5,401,446 to Tsai, et al.; U.S. Pat. No. 5,883,026 to Reader, et al.; U.S. Pat. No. 5,908,598 to Rousseau, et al.; U.S. Pat. No. 6,365,088 to Knight, et al., which are incorporated herein in their entirety by reference thereto for all purposes.

III. Articles

The nonwoven web may be used in a wide variety of applications. For example, the web may be incorporated into a "medical product", such as gowns, surgical drapes, facemasks, head coverings, surgical caps, shoe coverings, sterilization wraps, warming blankets, heating pads, and so forth. Of course, the nonwoven web may also be used in various other articles. For example, the nonwoven web may be incorporated into an "absorbent article" that is capable of absorbing water or other fluids. Examples of some absorbent articles include, but are not limited to, personal care absorbent articles, such as diapers, training pants, absorbent underpants, incontinence articles, feminine hygiene products (e.g., sanitary napkins), swim wear, baby wipes, mitt wipe, and so forth; medical absorbent articles, such as garments, fenestration materials, underpads, bedpads, bandages, absorbent drapes, and medical wipes; food service wipers; clothing articles; pouches, and so forth. Materials and processes suitable for forming such articles are well known to those skilled in the art. Absorbent articles, for instance, typically include a substantially liquid-impermeable layer (e.g., outer cover), a liquid-permeable layer (e.g., bodyside liner, surge layer, etc.), and an absorbent core. In one embodiment, for example, a nonwoven web formed according to the present invention may be used to form an outer cover of an absorbent article. If desired, the nonwoven web may be laminated to a liquid-impermeable film that is either vapor-permeable or vapor-impermeable.

The present invention may be better understood with reference to the following examples.

Test Methods

Apparent Viscosity:

The rheological properties of polymer samples were determined using a Göttfert Rheograph 2003 capillary rheometer with WinRHEO version 2.31 analysis software. The setup included a 2000-bar pressure transducer and a 30/1:0/180 roundhole capillary die. Sample loading was done by alternating between sample addition and packing with a ramrod. A 2-minute melt time preceded each test to allow the polymer to completely melt at the test temperature (usually 150 to 180° C.). The capillary rheometer determined the apparent viscosity (Pa·s) at various shear rates, such as 100, 200, 500, 1000, 2000, and 5000 $s^{-1}$. The resultant rheology curve of apparent shear rate versus apparent viscosity gave an indication of how the polymer would run at that temperature in an extrusion process.

Melt Flow Rate:

The melt flow rate ("MFR") is the weight of a polymer (in grams) forced through an extrusion rheometer orifice (0.0825-inch diameter) when subjected to a load of 2160 grams in 10 minutes, typically at 190° C. or 230° C. Unless otherwise indicated, the melt flow rate was measured in accordance with ASTM Test Method D1239 with a Tinius Olsen Extrusion Plastometer.

Tensile Properties:

Individual fiber specimens were shortened (e.g., cut with scissors) to 38 millimeters in length, and placed separately on a black velvet cloth. 10 to 15 fiber specimens were collected in this manner. The fiber specimens were then mounted in a substantially straight condition on a rectangular paper frame having external dimension of 51 millimeters×51 millimeters and internal dimension of 25 millimeters×25 millimeters. The ends of each fiber specimen were operatively attached to the frame by carefully securing the fiber ends to the sides of the frame with adhesive tape. Each fiber specimen was then be measured for its external, relatively shorter, cross-fiber dimension employing a conventional laboratory microscope, which has been properly calibrated and set at 40× magnification. This cross-fiber dimension was recorded as the diameter of the individual fiber specimen. The frame helped to mount the ends of the sample fiber specimens in the upper and lower grips of a constant rate of extension type tensile tester in a manner that avoided excessive damage to the fiber specimens.

A constant rate of extension type of tensile tester and an appropriate load cell were employed for the testing. The load cell was chosen (e.g., 10N) so that the test value fell within 10-90% of the full scale load. The tensile tester (i.e., MTS SYNERGY 200) and load cell were obtained from MTS Systems Corporation of Eden Prairie, Mich. The fiber specimens in the frame assembly were then mounted between the grips of the tensile tester such that the ends of the fibers were operatively held by the grips of the tensile tester. Then, the sides of the paper frame that extended parallel to the fiber length were cut or otherwise separated so that the tensile tester applied the test force only to the fibers. The fibers were then subjected to a pull test at a pull rate and grip speed of 12 inches per minute. The resulting data was analyzed using a TESTWORKS 4 software program from the MTS Corporation with the following test settings:

| Calculation Inputs | | Test Inputs | |
|---|---|---|---|
| Break mark drop | 50% | Break sensitivity | 90% |
| Break marker elongation | 0.1 in | Break threshold | 10 $g_f$ |
| Nominal gage length | 1 in | Data Acq. Rate | 10 Hz |
| Slack pre-load | 1 $lb_f$ | Denier length | 9000 m |
| Slope segment length | 20% | Density | 1.25 g/cm$^3$ |
| Yield offset | 0.20% | Initial speed | 12 in/min |
| Yield segment length | 2% | Secondary speed | 2 in/min |

The tenacity values were expressed in terms of gram-force per denier. Peak elongation (% strain at break), peak stress, and peak load were also measured.

EXAMPLE 1

A thermoplastic hydroxypropylated starch was formed as follows. Initially, a mixture of a hydroxypropylated starch (Glucosol 800, manufactured by Chemstar Products Company, Minneapolis, Minn.), surfactant (Excel P-40S, Kao Corporation, Tokyo, Japan), and plasticizer (sorbitol) was made. Glucosol™ 800 has a weight average molecular weight (determined by gel permeation chromatography) of 2,900,000, a polydispersity index of about 28, a bulk density of about 30 to 40 lbs/ft$^3$, and a $D_{98}$ particle size of 140 Mesh. A Hobart mixer was used for mixing. The mixture was then added to a K-Tron feeder (K-Tron America, Pitman, N.J.) that fed the material into a co-rotating, twin-screw extruder (ZSK-30, diameter of 30 mm) that was manufactured by Werner and Pfleiderer Corporation of Ramsey, N.J. The extruder possessed 14 zones, numbered consecutively 1-14 from the feed hopper to the die. The first barrel #1 received the mixture at 19 lbs/hr when the extruder was heated to a temperature for zones 1 to 7 of 100° C., 110° C., 124° C., 124° C., 124° C., 110° C., and 105° C., respectively. The melt temperature was 115° C. The screw speed was set at 160 rpm to achieve a melt pressure of 400-500 psi and a torque of between 50~60% during processing. The die used to form the thermoplastic starch had 3 openings that had a diameter of 5 millimeters and were separated by a distance of 3 millimeters. In some cases, a vent was also opened to release steam generated. The resulting strand cooled down through a cooling belt (Minarik Electric Company, Glendale, Calif.). A pelletizer (Emerson Industrial Controls, Grand Island, N.Y.) was used to cut the strand to produce thermoplastic starch pellets containing 66 wt. % starch, 30 wt. % sorbitol, and 4 wt. % surfactant. The melt flow rate of the resulting resin was determined to be 2.1 grams per 10 minutes (at 190° C., 2.16 kg).

EXAMPLE 2

A modified biodegradable polyester was formed as follows. An aliphatic-aromatic copolyester resin was initially obtained from BASF under the designation ECOFLEX® F BX 7011. The copolyester resin was modified by melt blending with a reactant solution. The reactant solution contained 87.5 wt. % 1,4-butanediol, 7.5 wt. % ethanol, and 5 wt. % titanium propoxide. The solution was fed by an Eldex pump to a liquid injection port located at barrel #5 of a co-rotating, twin-screw extruder (ZSK-30). The polyester resin was fed to the twin screw extruder at barrel #1 using a gravimetric feeder at a throughput of 30 pounds per hour. The extruder had four (4) die openings having a diameter of 6 millimeters and separated by a distance of 3 millimeters. Upon formation, the extruded resin was cooled on a fan-cooled conveyor belt and formed into pellets by a Conair pelletizer. The concentration of reactants in the modified polyester was approximately 99.475 wt. % of the copolyester, 0.5 wt. % 1,4-butanediol, and 0.025 wt. % titanium propoxide. Reactive extrusion parameters were monitored on the extruder during the reactive extrusion process. The conditions are shown below in Table 1.

TABLE 1

| Processing Conditions | | | | | | | | | | | | | | | |
|---|---|---|---|---|---|---|---|---|---|---|---|---|---|---|---|
| | Resin | Reactants | | | | | | | | | | | | | |
| | Feeding Rate | Butanediol | Titanium Propoxide | Extruder Speed | Extruder Temperature Profile (° C.) | | | | | | | | $P_{melt}$ | Torque |
| Sample No. | (lb/hr) | (%) | (ppm) | (rpm) | $T_1$ | $T_2$ | $T_3$ | $T_4$ | $T_5$ | $T_6$ | $T_7$ | $T_{melt}$ | (psi) | (%) |
| Example 2 | 30 | 0.5 | 250 | 160 | 160 | 190 | 190 | 190 | 190 | 190 | 125 | 137 | 70 | 85~90 |

Figure 2:
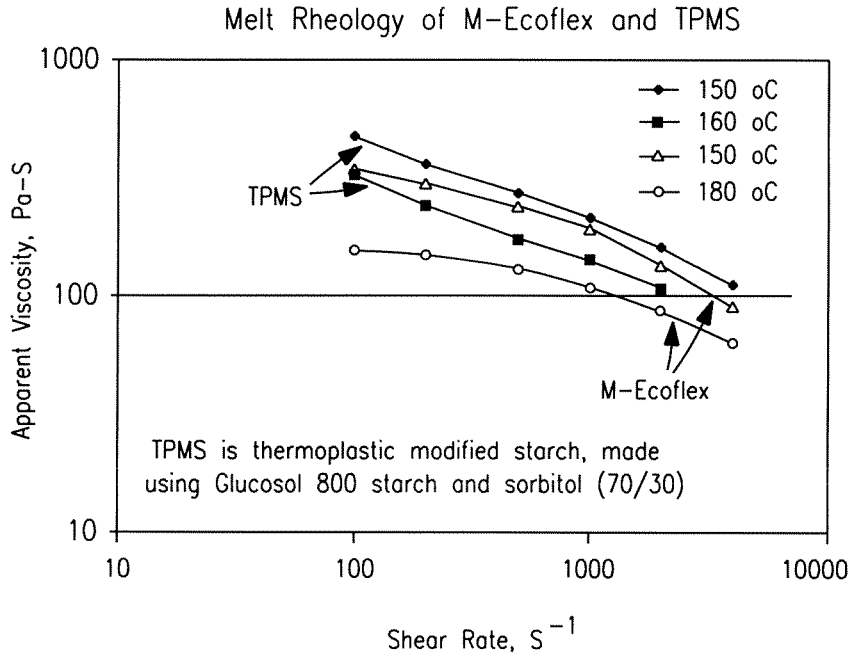
FIG. 2 is a graphical depiction of the apparent viscosity of the thermoplastic starch and modified copolyester of Examples 1 and 2 at various shear rates and temperatures.

The melt flow rate of the resulting resin was determined to be 25 grams per 10 minutes (at 190° C., 2.16 kg). The apparent viscosity of the resins of Examples 1 and 2 were also determined at 150° C. and 160° C. according to the procedure described above. The results are shown in FIG. 2. As indicated, the modified thermoplastic starch ("TPMS") and modified copolyester ("M-Ecoflex") both followed a shear-thinning behavior. Further, the viscosity of the thermoplastic starch was slightly greater than the modified polyester, indicating they are generally miscible materials, especially between the temperature range of 150° C. to 160° C.

EXAMPLES 3-6

Blends of the thermoplastic starch of Example 1 and the modified copolyester of Example 2 were prepared using a ZSK-30 extruder according to the processing conditions set forth below in Table 2.

TABLE 2

Processing Conditions for Compounding Fiber Blends

| Sample No. | Resin Feeding Rate (lb/hr) | TPS (lb/hr) | m-Ecoflex (lb/hr) | Extruder Speed (rpm) | Extruder Temperature Profile (° C.) $T_1$ | $T_2$ | $T_3$ | $T_4$ | $T_5$ | $T_6$ | $T_7$ | $T_{melt}$ | $P_{melt}$ (psi) | Torque (%) |
|---|---|---|---|---|---|---|---|---|---|---|---|---|---|---|
| Example 3 | 20 | 4 | 16 | 160 | 100 | 120 | 140 | 150 | 150 | 140 | 130 | 151 | 140~170 | 82~90 |
| Example 4 | 20 | 6 | 14 | 160 | 100 | 120 | 140 | 150 | 150 | 140 | 130 | 151 | 140~180 | 77~82 |
| Example 5 | 20 | 7.6 | 12.4 | 160 | 100 | 120 | 140 | 150 | 150 | 140 | 130 | 151 | 80~160 | 68~73 |
| Example 6 | 20 | 9 | 11 | 160 | 100 | 120 | 140 | 150 | 150 | 140 | 130 | 151 | 100~150 | 65~71 |

Figure 3:
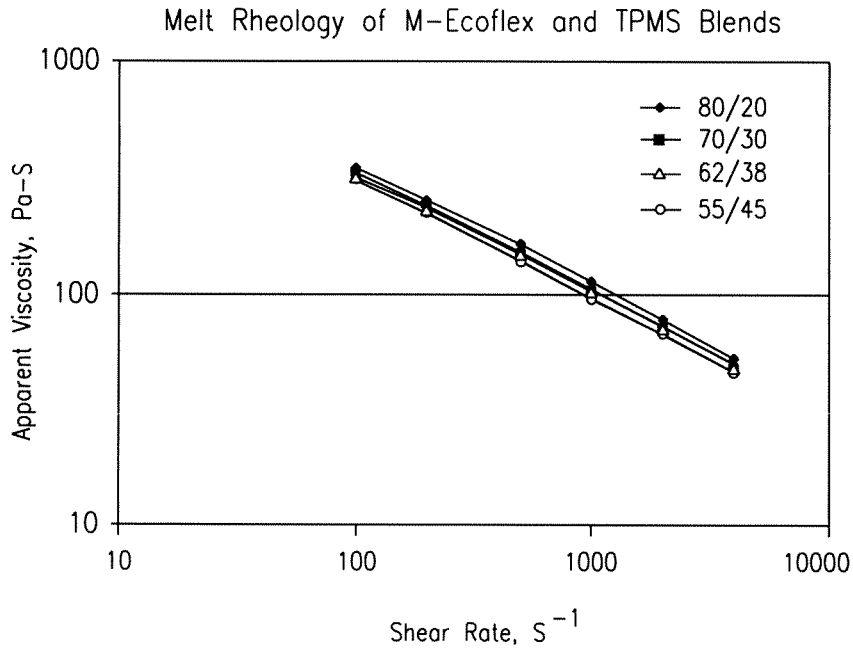
FIG. 3 is a graphical depiction of the apparent viscosity of the thermoplastic composition of Examples 3-6 at various shear rates.

The weight ratio of the modified copolyester ("m-Ecoflex") to the thermoplastic starch ("TPS") for Examples 3-6 was 80/20, 70/30, 62/38, and 55/45, respectively. Upon formation, the apparent viscosity of the blends was determined at 170° C. as described above. The results are shown in FIG. 3.

Thereafter, fiber spinning was conducted for the blends of Examples 3-6 using a Davis Standard fiber spinning line, which consists of two extruders, a quench chamber, and a godet with a maximum speed of 3000 meters per minute. The spinning die plate used for these samples was a 16-hole plate with each hole having a diameter of 0.6 millimeters. All samples were dried overnight at 170° F. to reduce the blend moisture content below 500 parts per million prior to fiber spinning. Table 3 lists the fiber spinning processing conditions.

TABLE 3

Fiber Spinning Parameters

| | | Example 3 | Example 4 | Example 5 | Example 6 |
|---|---|---|---|---|---|
| Extruder | Zone 7 (° C.) | 170 | 170 | 170 | 170 |
| | Zone 6 (° C.) | 165 | 165 | 165 | 165 |
| | Zone 5 (° C.) | 165 | 165 | 165 | 165 |
| | Zone 4 (° C.) | 160 | 160 | 160 | 160 |

TABLE 3-continued

Fiber Spinning Parameters

| | | Example 3 | Example 4 | Example 5 | Example 6 |
|---|---|---|---|---|---|
| | Zone 3 (° C.) | 160 | 160 | 160 | 160 |
| | Zone 2 (° C.) | 158 | 158 | 158 | 158 |
| | Zone 1 (° C.) | 155 | 155 | 155 | 155 |
| | Ext 1 Melt Outlet Pressure (psi) | 1010 | 1170 | 1050 | 1095 |
| Quench Readings | Lower Air | 355 | 355 | 350 | 244 |
| | Upper Air | 358 | 358 | 350 | 350 |
| Quench Set Point | Spin Beam (° C.) | 190 | 190 | 190 | 190 |
| | Godet Speed (m/min) | 900, 800, 600, 400 | 800, 700, 600, 400, 200 | 700, 600, 400 | 200, 100 |
| Misc. | Ext 1 Melt Pump (rpm) | 10 | 10/15 | 10 | 10 |
| | Pack Type | Mono-filament | Mono-filament | Mono-filament | Mono-filament |

As the modified polyester content decreased, fiber spinning processability deteriorated.

The fiber mechanical properties were also determined for the blends of Examples 3-6 for various drawing speeds. The results are set forth below in Table 4.

TABLE 4

Fiber Mechanical Properties

| Example No | Blend Ratio | Fiber Drawing Speed (m/min) | Peak Load (gf) | Peak Stress (Mpa) | Elongation (%) | Tenacity | Denier (gf) |
|---|---|---|---|---|---|---|---|
| Example 3 | m-Ecoflex/TPMS (80/20) | 900 | 3.1 | 75.6 | 240.2 | 0.69 | 4.53 |
| | m-Ecoflex/TPMS (80/20) | 800 | 3.8 | 77.1 | 257.6 | 0.70 | 5.44 |
| | m-Ecoflex/TPMS (80/20) | 600 | 4.1 | 86.2 | 194.7 | 0.78 | 5.61 |
| | m-Ecoflex/TPMS (80/20) | 400 | 4.6 | 67.7 | 219.8 | 0.61 | 8.51 |
| | m-Ecoflex/TPMS (80/20) | 250 | 4.4 | 59.4 | 296.7 | 0.54 | 8.33 |
| Example 4 | m-Ecoflex/TPMS (70/30) | 800 | 2.7 | 49.7 | 181.2 | 0.45 | 6.24 |
| | m-Ecoflex/TPMS (70/30) | 700 | 2.8 | 44.8 | 224.6 | 0.41 | 7.84 |
| | m-Ecoflex/TPMS (70/30) | 600 | 3.5 | 52.8 | 185.8 | 0.48 | 7.32 |
| | m-Ecoflex/TPMS (70/30) | 400 | 3.9 | 43.8 | 209.7 | 0.40 | 10.21 |
| | m-Ecoflex/TPMS (70/30) | 200 | 5.2 | 31.4 | 215.3 | 0.28 | 20.08 |
| Example 5 | m-Ecoflex/TPMS (62/38) | 700 | 1.9 | 36.9 | 144.5 | 0.34 | 6.25 |
| | m-Ecoflex/TPMS (62/38) | 600 | 2.4 | 33.3 | 147.4 | 0.30 | 8.16 |
| | m-Ecoflex/TPMS (62/38) | 400 | 2.6 | 31.5 | 152.9 | 0.29 | 9.70 |
| Example 6 | m-Ecoflex/TPMS (55/45) | 200 | 2.1 | 14.9 | 65.5 | 0.14 | 20.77 |
| | m-Ecoflex/TPMS (55/45) | 100 | 3.2 | 10.1 | 79.5 | 0.09 | 40.03 |

As indicated, the mechanical properties generally decrease with an increasing amount of the modified thermoplastic starch ("TPMS").

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method for forming a fiber comprising:

reacting a first aliphatic-aromatic copolyester with at least one alcohol to result in a second, modified copolyester having a melt flow index that is greater than the melt flow index of the first copolyester, determined at a load of 2160 grams and temperature of 190° C. in accordance with ASTM Test Method D1238-E;

combining the second copolyester with a thermoplastic starch to form a blend; and extruding the blend through a die to form a fiber.

2. The method of claim 1, wherein the ratio of the melt flow index of the second aliphatic-aromatic copolyester to the melt flow index of the first aliphatic-aromatic copolyester is at least about 1.5.

3. The method of claim 1, wherein the ratio of the apparent viscosity of the first aliphatic-aromatic copolyester to the apparent viscosity of the second aliphatic-aromatic copolyester is at least about 1.1, determined at a temperature of 170° C. and a shear rate of 1000 $sec^{-1}$.

4. The method of claim 1, wherein the second copolyester is terminated with an alkyl group, hydroxyalkyl group, or a combination thereof.

5. The method of claim 1, wherein the second copolyester has the following general structure:

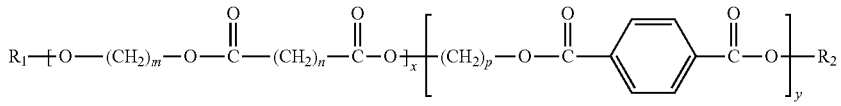

wherein, m is an integer from 2 to 10, in some embodiments from 2 to 4, and in one embodiment, 4;

n is an integer from 0 to 18, in some embodiments from 2 to 4, and in one embodiment, 4;

p is an integer from 2 to 10, in some embodiments from 2 to 4, and in one embodiment, 4;

x is an integer greater than 1;

y is an integer greater than 1; and $R_1$ and $R_2$ are independently selected from hydrogen; hydroxyl groups; straight chain or branched, substituted or unsubstituted $C_1$-$C_{10}$ alkyl groups; and straight chain or branched, substituted or unsubstituted $C_1$-$C_{10}$ hydroxyalkyl groups, with at least one of $R_1$ and $R_2$ being a straight chain or branched, substituted or unsubstituted $C_1$-$C_{10}$ alkyl group or $C_1$-$C_{10}$ hydroxyalkyl group.

6. The method of claim 5, wherein m and n are each from 2 to 4.

7. The method of claim 1, wherein the alcohol is employed in an amount of from about 0.1 wt. % to about 10 wt. %, based on the weight of the first copolyester.

8. The method of claim 1, wherein the alcohol is employed in an amount of from about 0.1 wt. % to about 4 wt. %, based on the weight of the first copolyester.

9. The method of claim 1, wherein the second copolyester has a melt flow index of from about 5 to about 200 grams per 10 minutes, determined at a load of 2160 grams and temperature of 190° C. in accordance with ASTM Test Method D1238-E.

10. The method of claim 1, wherein the melt flow index of the second copolyester is from about 10 to about 100 grams per 10 minutes.

11. The method of claim 1, wherein the second copolyester has an apparent viscosity of from about 50 to about 400 Pascal-seconds, determined at a temperature of 150° C. and a shear rate of 1000 $sec^{-1}$.

12. The method of claim 1, wherein the thermoplastic starch includes from about 40 wt. % to about 90 wt. % of at least one modified starch and from about 10 wt. % to about 45 wt. % of at least one plasticizer.

13. The method of claim 12, wherein the modified starch includes a starch ester, starch ether, or a combination thereof.

14. The method of claim 1, wherein the thermoplastic starch has an apparent melt viscosity of from about 25 to about 500 Pascal seconds, as determined at a temperature of 150° C. and a shear rate of 100 $sec^{-1}$.

15. The method of claim 1, wherein the thermoplastic starch has a melt flow index of from about 0.05 to about 50 grams per 10 minutes, determined at a load of 2160 grams and temperature of 190° C. in accordance with ASTM Test Method D1238-E.

16. The method of claim 1, wherein the blend is extruded at a temperature ranging from about 60° C. to about 180° C.

17. The method of claim 1, wherein the blend is extruded at a temperature ranging from about 80° C. to about 160° C.

* * * * *